US011490213B2

(12) United States Patent
Johannesson

(10) Patent No.: US 11,490,213 B2
(45) Date of Patent: Nov. 1, 2022

(54) BINAURAL HEARING AID SYSTEM PROVIDING A BEAMFORMING SIGNAL OUTPUT AND COMPRISING AN ASYMMETRIC VALVE STATE

(71) Applicant: GN Hearing A/S, Ballerup (DK)

(72) Inventor: René Burmand Johannesson, Espergærde (DK)

(73) Assignee: GN HEARING A/S, Ballerup (DK)

( * ) Notice: Subject to any disclaimer, the term of this patent is extended or adjusted under 35 U.S.C. 154(b) by 28 days.

(21) Appl. No.: 17/239,519

(22) Filed: Apr. 23, 2021

(65) Prior Publication Data

US 2021/0352421 A1 Nov. 11, 2021

(30) Foreign Application Priority Data

May 5, 2020 (DK) ..... PA 202070290

(51) Int. Cl.
*H04R 25/00* (2006.01)

(52) U.S. Cl.
CPC ..... *H04R 25/603* (2019.05); *H04R 25/43* (2013.01); *H04R 25/552* (2013.01); *H04R 25/554* (2013.01); *H04R 2420/07* (2013.01)

(58) Field of Classification Search
CPC .... H04R 25/603; H04R 25/43; H04R 25/552; H04R 25/554; H04R 2420/07
USPC ..... 381/312
See application file for complete search history.

(56) References Cited

U.S. PATENT DOCUMENTS 8,655,003 B2 2/2014 Duisters et al.
8,923,543 B2 * 12/2014 Sacha ..... H04R 25/456 381/328
10,932,076 B2 * 2/2021 Merks ..... H04S 7/30
(Continued)

FOREIGN PATENT DOCUMENTS

EP 3627848 3/2020
KR 10-1369272 3/2014
(Continued)

OTHER PUBLICATIONS

Extended European Search Report for EP Patent Appln. No. 21169826.1 dated Sep. 27, 2021.
(Continued)

*Primary Examiner* — Phylesha Dabney
(74) *Attorney, Agent, or Firm* — Vista IP Law Group, LLP

(57) ABSTRACT

The present disclosure relates to a binaural hearing aid system comprising hearing aids for placement at, or in, a user's left and right ear, the hearing aids each comprising a microphone arrangement, a wireless communications unit, a receiver, and a sound channel with a valve, which is movable from an open state to an closed state and from a closed state to an open state. The binaural hearing aid system further comprises a signal processing arrangement adapted for generating a beamformed signal based on microphone signals supplied by either or both of the microphone arrangement(s) and for applying the beamformed signal to either or both of the receiver(s), and a valve control arrangement configured to asymmetrically control the valves in each hearing aid by moving the valves into positions wherein one of the valves is opened more than the other.

20 Claims, 5 Drawing Sheets

(56) References Cited

U.S. PATENT DOCUMENTS

| | | | |
|---|---|---|---|
| 2019/0116436 | A1 | 4/2019 | Lawand et al. |
| 2019/0215621 | A1 | 6/2019 | Albahri et al. |

FOREIGN PATENT DOCUMENTS

| | | |
|---|---|---|
| WO | WO 2010/140087 | 12/2010 |
| WO | WO 2019/052715 | 3/2019 |

OTHER PUBLICATIONS

Foreign 1st Technical Exam Report for Danish Patent Appln. No. PA 2020 70290 dated Oct. 8, 2020.
Foreign Technical Examination Report for Danish Patent Appln. No. PA 2020 70290 dated Apr. 22, 2021.

* cited by examiner

BINAURAL HEARING AID SYSTEM PROVIDING A BEAMFORMING SIGNAL OUTPUT AND COMPRISING AN ASYMMETRIC VALVE STATE

RELATED APPLICATION DATA

This application claims priority to, and the benefit of, Danish Patent Application No. PA 2020 70290 filed on May 5, 2020. The entire disclosure of the above application is expressly incorporated by reference herein.

FIELD

The present disclosure relates to a binaural hearing aid system, which provides a beamformed signal to at least one receiver of the binaural hearing aid system. Each hearing aid in the binaural hearing aid system comprises a sound channel within which a valve is either open or closed. The valves in the two hearing aids are in an asymmetric state, wherein one of the two valves is opened more than the other.

Further, the disclose relates to a method of providing a beamformed signal to one receiver of the binaural hearing aid system, an omnidirectional signal to the other receiver of the binaural hearing aid system and closing the valve in one sound channel while opening the valve in the other sound channel.

BACKGROUND

Normal hearing individuals are capable of selectively paying attention to e.g. a target speaker to achieve speech intelligibility and to maintain situational awareness under noisy listening conditions such as restaurants, bars, concert venues etc., i.e. in so-called cocktail party scenarios. Normal hearing individuals are capable of utilizing a better-ear listening strategy where the individual focusses his or her attention on the speech signal of the ear with the best signal to noise ratio for the target talker or speaker, i.e. a desired sound source. This better-ear listening strategy can also allow for monitoring off-axis unattended talkers by cognitive filtering mechanisms such as selective attention.

In contrast, it remains a challenging task for hearing impaired individuals to listen to a particular, desired sound source in such noisy sound environments and at the same time maintain environmental awareness by monitoring off-axis or unattended talkers. Hence, it is desirable to provide similar hearing capabilities to hearing impaired individuals for example by exploiting well-known spatial filtration capabilities of existing binaural hearing aid systems. However, the use of binaural hearing aid systems and associated beamforming technology often focuses on increasing or improving a signal to noise ratio (SNR) of a bilaterally or binaurally beamformed microphone signal or signals for incoming sounds at a particular target direction, often in the frontal direction of the individual, at the expense of decreasing the audibility of the unattended, often off-axis located, talkers in the sound environment. The signal to noise ratio improvement of the binaurally beamformed microphone signal is caused by a high directivity index of the binaurally beamformed microphone signal which means that sound sources placed outside a relatively narrow angular range around the selected target direction are heavily attenuated or suppressed. The narrow angular range wherein sound sources remain substantially unattenuated may extend merely +/−20-40 degrees azimuth around the target direction. This property of the binaurally beamformed microphone signal leads to an unpleasant so-called "tunnel hearing" sensation for the hearing-impaired individual or patient/user wherein situational awareness is lost.

There is a need in the art for binaural hearing aid systems which provide hearing impaired individuals with improved speech intelligibility in cocktail party sound environments, or similar adverse listening conditions, but without sacrificing off-axis awareness to provide increased situational awareness.

SUMMARY

The present disclosure relates to a binaural hearing aid system, which provides a beamformed signal to at least one receiver of the binaural hearing aid system. A sound channel in each hearing aid is configured to allow for ambient sound from outside the hearing aid to reach the ear canal of the user. Within the sound channel of each hearing aid a valve is either open or closed such that ambient sound may either travel in the sound channel or is hindered from travelling in the sound channel, respectively. The valves are in an asymmetric state, wherein one of the valves in the hearing aids is opened more than the other. The binaural hearing aid system uses ear-to-ear wireless exchange or streaming of a plurality of monaural directional signals over a wireless communication link. The left ear or right ear hearing aid is configured to generate a bilaterally or monaurally beamformed signal with a high directivity index that may exhibit maximum sensitivity in a target direction, e.g. at the user's look direction, and reduced sensitivity at the respective ipsilateral sides of the left and right ear hearing aids. The opposite ear hearing aid may generate a bilateral omnidirectional signal at the opposite ear by mixing a pair of the monaural directional signals, wherein the bilateral omnidirectional signal exhibits an omnidirectional response or polar pattern with a low directivity index and therefore substantially equal sensitivity for all sound incidence directions or azimuth angles around the user's head.

The effect of providing a beamformed signal and, optionally, an omnidirectional signal as described above can be further enhanced by having a valve in the sound channel of each hearing aid and configuring the valves to be in an asymmetric state, i.e. in a state where both valves are not equally open or closed. An open valve in the sound channel of a hearing aid will allow ambient sound to travel through the sound channel to the ear of the user, while a closed valve will act to hinder ambient sound from travelling to the ear of the hearing aid user.

A closed valve provides a good low frequency gain and reduces ambient noise travelling to the ear drum, which increases the effectiveness of the beamforming and noise reduction and therefore increases speech intelligibility. A drawback of the closed valve is occlusion, which causes a strange perception of the user's own voice, a reduced ability of the user to control the level of own voice and uncomfortable noises when chewing, walking or running.

An open valve reduces occlusion and is therefore perceived as more comfortable for the user. Drawbacks of the open valve includes reduced sound quality as the open valve does not provide a good low frequency gain and further, reduced speech intelligibility.

By providing a valve in the sound channel of each hearing aid the user can experience the benefits of the open or closed valve within the same hearing aid and can change the state of one or both of the valves to best suit the situation thus enabling the choice of the lesser of two evils in any given scenario. An asymmetric state, wherein one valve is more open than other valve will therefore increase the effectiveness of the binaural hearing aid system and improve the experience of the user.

A binaural hearing aid system, which generates a beamformed signal for one ear and an omnidirectional signal for the other ear exploits the human cognitive capability of sound source segregation and integration to allow the hearing impaired individual to focus on a clean target signal provided by the bilaterally or monaurally beamformed signal and simultaneously monitor off-axis sound sources/talkers by using the omnidirectional signal.

A first aspect relates to a binaural hearing aid system comprising: a first hearing aid for placement at, or in, a user's left or right ear, the first hearing aid comprising a first microphone arrangement, a first wireless communications unit, a first receiver, and a first sound channel comprising a first valve which is movable from an open state to a closed state and from a closed state to an open state;

a second hearing aid for placement at, or in, the user's opposite ear, the second hearing aid comprising a second microphone arrangement, a second wireless communications unit, and a second sound channel comprising a second valve which is movable from an open state to a closed state and from a closed state to an open state; a signal processing arrangement adapted for generating a beamformed signal based on microphone signals supplied by the first and/or second microphone arrangement(s) and for applying the beamformed signal to the first and/or second receiver(s), wherein the signal processing arrangement is further adapted for generating an omnidirectional signal based on microphone signals supplied by the first and/or second microphone arrangement(s), and the signal processing arrangement is further adapted for applying the beamformed signal to one of the first or the second receiver and applying the omnidirectional signal to the other one of the first or the second receiver; and a valve control arrangement which has an asymmetric mode, in which asymmetric mode the valve control arrangement is configured to asymmetrically control the first and second valves by moving the first and second valves into positions, wherein one of the first or second valves is opened more than the other of the first or second valves, and the valve control arrangement is further configured to open the valve, which is comprised in the hearing aid comprising the receiver to which the omnidirectional signal is applied, more than the valve, which is comprised in the hearing aid comprising the receiver to which the beamformed signal is applied, when in the asymmetric state.

That one of the two valves is opened more than the other means that one may be closed and the other open to some extent or that both are open, but that one is open to a greater extent than the other.

The signal processing arrangement is adapted to process microphone signals from the first and second microphone arrangements by compensating for a hearing impairment of the user. In this context, and in common hearing aid terminology, the meaning of the term receiver depends on the context. In the context of radio/wireless communication a receiver may be the receiving unit of a wireless signal. In this case however, a receiver refers to the loudspeakers which provide the audio signals to the ear canals of the user after processing by the signal processing arrangement. It will be obvious to the skilled person, from the context, be it wireless communication or providing an audio signal to a user, which of the two meanings is applicable in a given passage of this application.

In an embodiment, the processing arrangement comprises a first processing unit located in the first hearing aid and a second processing unit located in the second hearing aid. The first and second processing units may operate independently of each other, they may be in a master/slave configuration where one sends control signal to the other the other, or they may work in cooperation to perform beamforming, compensation of a hearing impairment, etc. on the signal provided by the microphone arrangements. By providing each of the first and second hearing aids with separate processing units, the hearing aid system will achieve a more efficient processing and rely less on the communication link.

In an embodiment of the binaural hearing aid system the valve control arrangement is additionally configured to fully close the first valve, when the second valve is opened and to fully close the second valve, when the first valve is opened.

The first sound channel may be located in a part of the first hearing aid which resides in an ear canal of the user during use and the second sound channel may be located in a part of the second hearing aid, which resides in the opposite ear canal of the user during use.

The first sound channel and the first valve may have the same form factor as the second sound channel and the second valve, respectively. That is, the first and second channels may be substantially identical in their dimensions and shape and, likewise, the first and second valves may be substantially identical in their dimensions and shape. Further, the first and second sound channels may be made from the same material(s). Likewise, the first and second valve may be made from the same material(s).

In an embodiment of the binaural hearing aid system the first valve is further configured to open at least partially or close at least partially in response to a first valve control signal and the second valve is further configured to open at least partially or close at least partially in response to a second valve control signal, where the first and second valve control signals are generated by the valve control arrangement.

In an embodiment of the binaural hearing aid system the valve of the first or the second hearing aid is opened by the valve control arrangement in response to an omnidirectional signal being applied to the receiver of the first or second hearing aid, respectively; and/or the valve of the first or second hearing aid is closed by the valve control arrangement in response to a beamformed signal being applied to the receiver of the first or second hearing aid, respectively.

In an embodiment of the binaural hearing aid system the valve control arrangement is adapted to engage the asymmetric state in response to the hearing aid system entering a conversation mode, the conversation mode being entered upon request by the user or in response to a signal strength of a microphone signal from the first and/or second microphone arrangements crossing a noise threshold.

In an embodiment of the binaural hearing aid system, the beamformed signal is based at least on two or more microphone signals supplied in response to incoming sound by the microphone arrangement comprised in the hearing aid comprising the receiver to which the beamformed signal is applied.

During hearing aid fitting, a hearing aid dispenser or audiologist may select the user's ear with the largest hearing loss to receive the omnidirectional signal while the user's better ear receives the (bilaterally or monaurally) beamformed signal. The respective hearing losses of the patient's or user's left and right ears may be determined by the dispenser before or during fitting of the binaural hearing aid system. The signal processing arrangement of the binaural hearing aid system may be configured to perform hearing loss compensation of the bilaterally or monaurally beamformed signal and may be further configured to perform hearing loss compensation of the omnidirectional signal.

The valve control arrangement is further configured to open the valve, which is comprised in the hearing aid comprising the receiver to which the omnidirectional signal is applied, more than the valve, which is comprised in the hearing aid comprising the receiver to which the beamformed signal is applied, when in the asymmetric state.

In this way the valve, which corresponds to the one of the first or the second receiver to which the omnidirectional signal is applied, is opened more than the valve, which corresponds to the one of the first or the second receiver to which the beamformed signal is applied.

The respective hearing aids of the binaural hearing aid system may be fitted to the user or hearing impaired individual such that the ear with the largest hearing loss receives the bilateral omnidirectional signal and the ear with the smallest hearing loss, or best hearing ability, receives the bilateral beamforming signal. The respective hearing losses of the patient's or user's left and right ears may be determined by a dispenser in connection with hearing aid fitting using conventional means to determine the user's left ear and right ear hearing losses. In this manner, the hearing impaired individual can exploit a better-ear listening strategy, where the individual focusses his or her attention on the target speaker, located in a target direction, using the ear that receives the bilaterally or monaurally beamformed signal which has a good signal to noise ratio (SNR) for the target speaker due to the large attenuation of all sound sources situated outside a narrow angular range around the target direction. A closed valve in the ear that receives the beamformed signal, while having the drawback of occlusion, assists in providing an improved sound quality and speech intelligibility by reducing ambient sound to the ear. The omnidirectional signal allows the hearing-impaired individual to monitor off-axis sound sources, i.e. sound sources situated outside the narrow angular range around the target direction, using the opposite ear by cognitive filtering mechanisms, such as selective attention. The omnidirectional signal reproduced to the user's other ear provides the user with good situational awareness and therefore at least partly eliminates the undesired "tunnel hearing" sensation associated with traditional beamforming algorithms and binaural hearing aid systems. Further, an open valve in the ear that receives the omnidirectional signal will assist in providing an improved ambient awareness.

The skilled person will understand that the signal processing arrangement may be configured to perform hearing loss compensation of the bilateral beamforming signal before application of the signal to the user's left or right hearing aid. The hearing loss compensation of the bilateral beamforming signal may be determined based on an individually measured or determined hearing loss of the ear in question during a hearing aid fitting procedure for example at a dispenser's office. Likewise, the signal processing arrangement may be configured to perform hearing loss compensation of the bilateral omnidirectional signal. The hearing loss compensation of the bilateral omnidirectional signal may be determined based on an individually measured or determined hearing loss of the ear in question during the hearing aid fitting procedure.

In an embodiment of the binaural hearing aid system the omnidirectional signal is a bilateral omnidirectional signal based on microphone signals supplied by the first and second microphone arrangements.

In an embodiment of the binaural hearing aid system the microphone signal supplied by the hearing aid comprising the receiver to which the beamformed signal is applied is time delayed relative to the microphone signal supplied by the hearing aid comprising the receiver to which the omnidirectional signal is applied before the two microphone signals are mixed to generate the bilateral omnidirectional signal.

In this way, a first monaural directional signal, supplied by the microphone in the hearing aid comprising the receiver to which the beamformed signal is applied, is time delayed relative to a second monaural directional signal, supplied by the microphone in the hearing aid comprising the receiver to which the omnidirectional signal is/will be applied, before the mixing of the first and second monaural directional signals. The relative time delay between the first monaural directional signal and the second monaural directional signal may be between 3 ms and 50 ms such as between 5 ms and 20 ms, wherein the time delay is determined at 2 kHz. This relative time delay between the first and second monaural directional signal provides a beneficial auditory fusion between these signals by exploiting the so-called Haas effect and other advantages as discussed in additional detail below with reference to the appended drawings.

In an embodiment of the binaural hearing aid system the hearing aid system further comprises an omnidirectional processing arrangement, which comprises a first omnidirectional signal processor and a second omnidirectional signal processor; the first omnidirectional signal processor being arranged in a housing of the hearing aid comprising the receiver to which the beamformed signal is applied and being configured to:

generating a first monaural directional signal, transmitting, through a wired or wireless communication link, the first monaural directional signal to the hearing aid comprising the receiver to which the omnidirectional signal is applied; and the second omnidirectional signal processor being arranged in a housing of the hearing aid comprising the receiver to which the omnidirectional signal is applied and being configured to:

receiving the first monaural directional signal, transmitted by the other hearing aid, through the wired or wireless communication link, generating a second monaural directional signal and mixing the first and second monaural directional signals in a fixed or adjustable ratio to generate a bilateral omnidirectional signal.

In an embodiment of the binaural hearing aid system the signal processing arrangement and the omnidirectional processing arrangement are comprised in the same processing unit.

In an embodiment of the binaural hearing aid system, the signal processing arrangement comprises a first signal processing unit housed in the first hearing aid and a second signal processing unit housed in the second hearing aid.

A second aspect relates to a method of providing a beamformed signal at a left or right ear of a hearing aid user and a bilateral omnidirectional signal at the opposite ear of the hearing aid user, the method comprising:

by a beamforming arrangement generating a bilaterally or monaurally beamformed signal based at least on two or more microphone signals supplied by a microphone arrangement of a hearing aid in the user's left or right ear;

converting the bilaterally or monaurally beamformed signal into a corresponding audible signal for the user's corresponding left or right ear;

by an omnidirectional processing arrangement generating a first monaural directional signal based on one or more microphone signals supplied by the microphone arrangement of a hearing aid in the user's left or right ear;

by an omnidirectional processing arrangement generating a second monaural directional signal based on one or more microphone signals supplied by the microphone arrangement of the opposite hearing aid;

mixing the first and second monaural directional signals in a fixed or adjustable ratio to generate the bilateral omnidirectional signal;

converting the bilateral omnidirectional signal into a corresponding audible signal for the user's opposite ear, and by a valve control arrangement carrying out steps of closing the valve in the hearing aid in the user's left or right ear; and opening the valve in the hearing aid in the user's opposite ear.

In an embodiment of the method, the method further comprises: by the valve control arrangement carrying out the step of opening the valve, which is comprised in the hearing aid from which the audible omnidirectional signal emanates, more than the valve, which is comprised in the other hearing aid from which the audible beamformed signal emanates.

In an embodiment of the method, the step of the valve control arrangement further comprises that the valve, which is closed, is closed fully, while the valve that is opened is opened fully.

In an embodiment of the method, the step of the valve control arrangement further comprises that the valves open or close in response to valve control signals.

In an embodiment of the method, the step of mixing the first and second monaural directional signals further comprises: the microphone signal supplied by the hearing aid from which the audible beamformed signal will emanate is time delayed relative to the microphone signal supplied by the hearing aid from which the audible omnidirectional signal will emanate before the two microphone signals are mixed to generate the bilateral omnidirectional signal.

Exemplary Signal Processing of the Signal Processing Arrangement

In one embodiment of the binaural hearing aid system the signal processing arrangement is configured to generate the bilateral omnidirectional signal by mixing first and second monaural directional signals according to:

$$S=\beta*dl+(1-\beta)dr_{e2e}(t1);$$

wherein:

S: is a time-domain representation of the bilateral omnidirectional signal based on a mixture of the first and second monaural directional signals;

dl: is a time-domain representation of the second monaural directional signal;

$dr_{e2e}(t1)$: is a time-domain representation of the first monaural directional signal with a relative time delay of (t1), β: is scalar scaling factor between 0 and 1 setting the mixing ratio of the first and second monaural directional signals or a filter to set a frequency-dependent mixing ratio of the first and second monaural directional signals.

In one such embodiment the signal processing arrangement is configured to adaptively adjust the scaling factor, β, in accordance with relative powers of the first and second monaural directional signals, for example by computing, β, in accordance with:

$$\beta=\frac{dl^2}{dl^2+dr^2}$$

The signal processing arrangement is configured to adaptively adjust the scaling factor, β, to maximize power of the bilateral omnidirectional signal, S; or adaptively adjust coefficients of the digital filter to maximize power of the bilateral omnidirectional signal S. The filter, which may set the frequency-dependent mixing ratio of the first and second monaural directional signals, may comprise a digital filter such as a FIR filter or IIR filter.

In an embodiment the scaling factor, β, comprises a linear phase FIR filter with a group delay, d, and the signal processing arrangement is configured to generate the bilateral omnidirectional signal according to:

$$S=\beta*dl+(z^{-d}-\beta)dr_{e2e}(t1).$$

The presence of respective microphone sound inlets inside each of the user's left and right ear canals, for example on an outwardly oriented surface of an ITE, ITC, CIC, RIC housing structure of the hearing aid or ear plug in question allows the first and second monaural directional signals to be formed in a computationally efficient manner.

According to one embodiment of the binaural hearing aid system and the method of providing a beamformed signal at a left or right ear of a hearing aid user and a bilateral omnidirectioncal signal at the opposite ear of the hearing aid user, the signal processing arrangement is further configured to adaptively compute the bilateral beamforming signal based on a fourth monaural directional signal and a third monaural directional signal using a time delay and sum mechanism; said computation comprising minimizing a cost function C(α, β) according to:

$$C(\alpha,\beta)=\{E\{(\alpha Z_l+\beta Z_r)\cdot(\alpha Z_l^*+\beta Z_r^*)\}+\lambda*(\alpha+\beta-1)+\lambda(\alpha+\beta-1)^*$$

under the constraint α+β=1; and wherein

E represents statistical expectation, $dl_i$ represents the i-th subband of the fourth monaural directional signal, $dr_i$ represents the i-th subband of the third monaural directional signal; and and * indicates the conjugation of a complex function.

According an embodiment of the binaural hearing aid system, the signal processing arrangement is further configured to generate the first monaural directional signal, dl (f, Ø), according to:

$$dl(f,\emptyset)=F_{fl}(f,b)*H_{fl}(f,\emptyset)+F_{bl}(f,a)*H_{bl}(f,\emptyset);$$

and the signal processing arrangement is configured to generate the second monaural directional signal, dr (f, Ø), according to:

$$dr(f,\emptyset)=F_{fr}(f,d)*H_{fr}(f,\emptyset)+F_{br}(f,c)*H_{br}(f,\emptyset);$$

wherein Ø represents an angle to the sound source and Ø=0 is the target direction, $H_{fl}(f, \emptyset)$ represents a head related transfer function of the first microphone of the second hearing aid as measured on an acoustic manikin, such as KEMAR or HATS, $H_{bl}(f, \emptyset)$ represents a head related transfer function of the second microphone of the second hearing aid as measured on an acoustic manikin, such as KEMAR or HATS, $H_{fr}(f, \emptyset)$ represents a head related transfer function of the first microphone of the first hearing aid as measured on an acoustic manikin, such as KEMAR or HATS, $H_{br}$ (f, Ø) represents a head related transfer function of the second microphone of the first hearing aid as measured on an acoustic manikin, such as KEMAR or HATS; and $F_{fl}$(f, b) represents a frequency response of a first discrete time filter, e.g. FIR filter, of the first hearing aid, $F_{bl}$(f, a) represents a frequency response of a second discrete time filter, e.g. FIR filter of the first hearing aid, $F_{fr}$(f, d) represents a frequency response of a first discrete time filter, e.g. FIR filter of the second hearing aid, $F_{br}$(f, Ø) represents a frequency response of a second discrete time filter, e.g. FIR filter, of the second hearing aid;

wherein respective sets of filter coefficients a, b, c and d of the filters $F_{bl}$(f, a), $F_{fl}$(f, b) $F_{br}$(f, c), $F_{fr}$(f, d) are determined by minimizing the cost function:

$$\underset{a,b,c,d}{\mathrm{ARGmin}} \int\int \begin{pmatrix} w_o(f,\theta) * (trueOmniTarget(f,\theta) - \\ \max_p(\|P^l(f,\emptyset)\|, \|P^r(f,\emptyset)\|))^2 + \\ w_{zeroL}(f) * ((\|P^l(f,\emptyset)\| - \|\text{reference} \\ (f,\emptyset l)\|)^2|_{\theta l=\text{referece}-\text{directionLeftEar}} + \\ w_{zeroR}(f) * ((\|P^r(f,\emptyset)\| - \text{reference} \\ (f,\emptyset r)\|)^2|_{\theta r=\text{referece}-\text{directionRightEar}} \end{pmatrix} df d\theta$$

wherein trueOmniTarget(f, θ) is a selected target function of the bilateral omnidirectional signal;

$P^l$ is a frequency response of the first monaural directional signal;

$P^r$ is a frequency response of the second monaural directional signal;

$W_o$, $W_{zeroL}$ and $W_{zeroR}$ are respective weight functions representing trade-off costs over frequency, and optionally sound source angles, between three components of the cost function.

The respective sensitivities or responses of the polar pattern of the bilaterally or monaurally beamformed signal and bilateral omnidirectional signal may be determined at 2 kHz using a narrowband test signal such as a sine wave with the binaural hearing aid system appropriately mounted on an acoustic manikin. The respective sensitivities of the polar patterns may be determined by alternative types of test signals such as a 1.5 kHz-5 kHz bandlimited white noise signal. The latter measurement condition may give more representative results of real-world performance of the binaural hearing aid system due to the averaging across a frequency range important for speech understanding.

The acoustic manikin may be a commercially available acoustic manikin such as KEMAR or HATS or any similar acoustic manikin which is designed to simulate or represent average acoustic properties of the human head and torso. The skilled person will appreciate that the above-mentioned polar patterns typically will be about the same when the binaural hearing aid system is appropriately arranged on a user or patient as on the acoustic manikin. However, the reference to the acoustic manikin based determination ensures well-defined and reproducible measurement conditions.

BRIEF DESCRIPTION OF THE DRAWINGS

In the following exemplary embodiments are described in more detail with reference to the appended drawings, wherein.

DETAILED DESCRIPTION OF EMBODIMENTS

Figure 1:
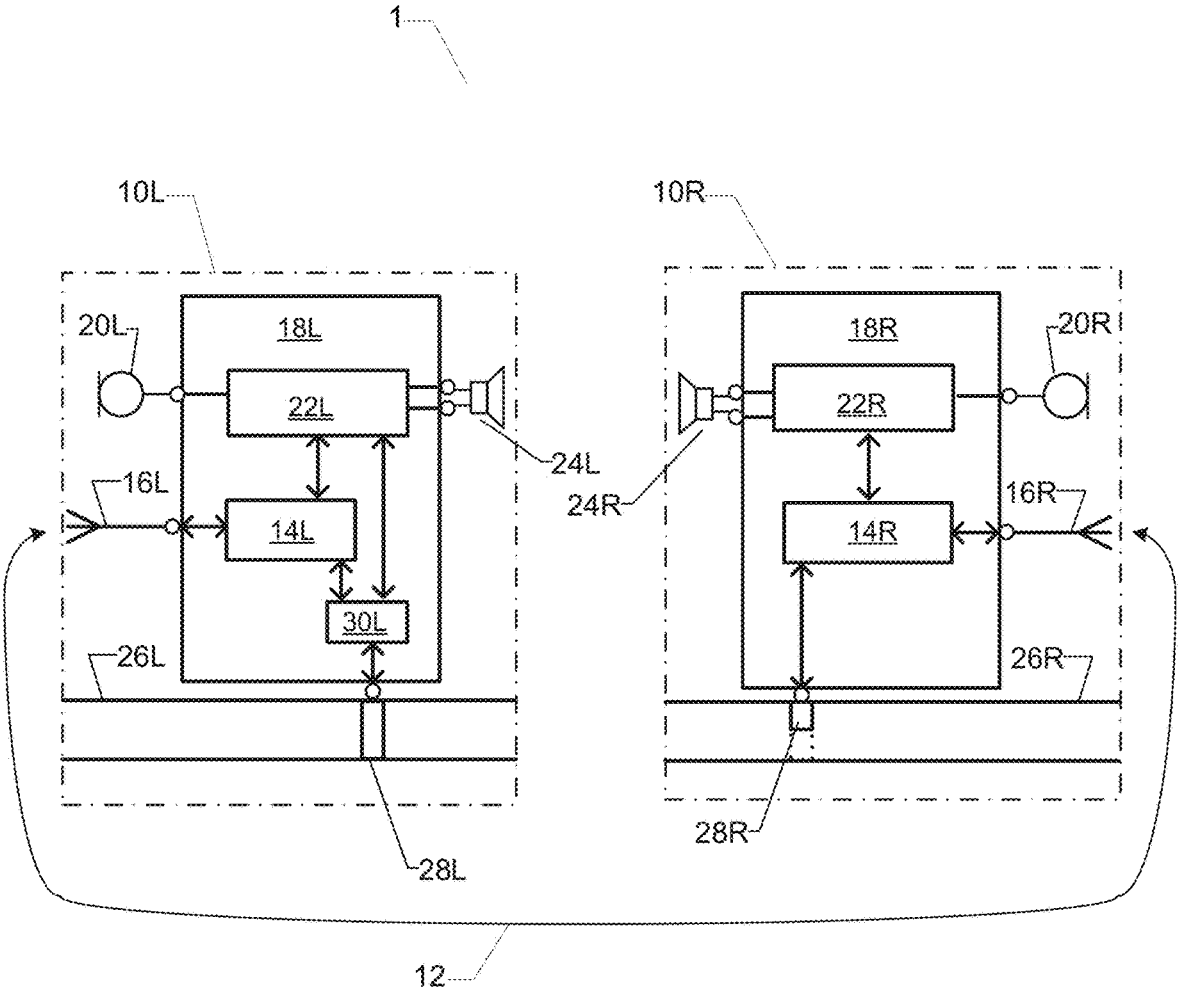
FIG. 1 schematically illustrates a binaural hearing aid system comprising a left ear hearing aid and a right ear hearing aid connected via a bidirectional wireless data communication channel in accordance with exemplary embodiments.

In the following various exemplary embodiments of the present binaural hearing aid system are described with reference to the appended drawings. It should be noted that the figures may or may not be drawn to scale and that elements of similar structures or functions are represented by like reference numerals throughout the figures. Like elements will, thus, not necessarily be described in detail with respect to each figure. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 schematically illustrates a binaural hearing aid system 1 comprising a left ear hearing aid 10L and a right ear hearing aid 10R each of which hearing aids 10L, 10R comprises a wireless communication unit 14L, 14R for connection to the other hearing aid. In the present embodiment, the left ear and right ear hearing aids 10L, 10R are connected to each other via a bidirectional wireless, or possibly wired, data communication connection or link 12, which supports real-time streaming of digitized microphone signals. A unique ID may be associated with each of the left ear and right ear hearing aids 10L, 10R. Each of the illustrated wireless communication units 14L, 14R of the binaural hearing aid system 1 may be configured to operate in the 2.4 GHz industrial scientific medical (ISM) band and may be compliant with a Bluetooth LE standard. Alternatively, each of the illustrated wireless communication units 14L, 14R may comprise magnetic coil antennas 16L, 16R and based on near-field magnetic coupling such as the NMFI operating in the frequency region between 10 and 20 MHz.

The left hearing aid 10L and the right hearing aid 10R may be substantially identical in some embodiments of the present hearing aid system except for the above-described unique ID such that the following description of the features, components and signal processing functions of the left hearing aid 10L also applies to the right hearing aid 10R unless otherwise noted. The left hearing aid 10L may comprise a $ZnO_2$ battery (not shown) or a rechargeable battery that is connected for supplying power to the hearing aid circuit 18L. The left hearing aid 10L comprises a microphone arrangement 20L that preferably at least comprises first, and possibly second, omnidirectional microphones as discussed in additional detail below.

The left hearing aid 10L further comprises a sound channel 26L, which is configured such that ambient sound can travel, via the sound channel 26L, from outside the hearing aid 10L to the ear canal of the hearing aid user. Depending on the type of hearing aid 10L, the sound channel may be located in the part of the hearing aid 10L, which resides in the ear canal of the user during use. Within the sound channel 26L a valve 28L is movable from an open state to a closed state and from a closed state to an open state. When in an open state the valve 28L may be partially or fully open. A closed valve 28L will act to hinder ambient sound from travelling to the ear canal of the hearing aid user, while an open valve 28L will allow ambient sound to travel to the ear canal of the hearing aid user. The more open a valve 28L is, the easier it will be for ambient sound to travel in the sound channel 26L.

The state of the valve 28L is controlled by means of a valve control signal, which is generated by a valve control arrangement 30L. Both left and right hearing aids 10L, 10R may comprise a valve control arrangement 30L, 30R or a single valve control arrangement, e.g. in the left hearing aid 10L, may control the state of both valves via the wireless communication units 14L, 14R. The valve control arrangement is configured to have an asymmetric state, whereby it sets the position of the two valves 28L, 28R, i.e. the valve 28L in the left hearing aid 10L and the valve 28R in the right hearing aid 10R, in an asymmetric configuration such that one valve is opened more than the other valve as illustrated in FIG. 1, where one valve 28L is fully closed, while the other valve 28R is partially open. The asymmetric state may be configured such that one valve 28L, 28R is fully closed, when the other valve 28L, 28R is open, i.e. such that only one of the valves 28L, 28R in the left and right hearing aids 10L, 10R is partially or fully open, while the other is fully closed.

The left hearing aid 10L additionally comprises a signal processing unit 22L that may comprise a hearing loss processor. The signal processing unit 22L is also configured to create monaural and/or bilateral beamformed signal based on microphone signals from the left hearing aid 10L and/or on a contralateral microphone signal, i.e. a microphone signal from the other, here right, hearing aid. The hearing loss processor is configured to compensate for a hearing loss of a user of the left hearing aid 10L. Preferably, the hearing loss processor comprises a well-known dynamic range compressor circuit or algorithm for compensation of frequency dependent loss of dynamic range of the user often termed recruitment in the art. Accordingly, the signal processing unit 22L can generate and output a beamformed audio signal with additional hearing loss compensation to a loudspeaker or receiver 24L. The loudspeaker or receiver 24L converts the electrical audio signal into a corresponding acoustic signal for transmission into the left ear canal of the user.

The opposite ear hearing aid, in this example the right hearing aid, may generate a monaural or bilateral omnidirectional signal at the opposite ear of the user, where a bilateral omnidirectional signal is based on microphone signals supplied by both the left hearing aid 10L and the right hearing aid 10R. An omnidirectional signal may be generated by mixing a pair of the monaural signals. A bilateral omnidirectional signal exhibits an omnidirectional response or polar pattern with a low directivity index and therefore substantially equal sensitivity for all sound incidence directions or azimuth angles around the user's head, i.e. the shadow effect of the user's head is reduced.

The binaural hearing aid system 1 may additionally comprise an omnidirectional processing arrangement, not shown, which comprises a first omnidirectional signal processor and a second omnidirectional signal processor. The omnidirectional processing arrangement and the signal processing arrangement may be comprised within the same processing unit. The first omnidirectional signal processor is arranged in a housing of the hearing aid comprising the receiver to which a beamformed signal is applied and is configured to generate a first monaural directional signal, transmit the first monaural directional signal to the hearing aid comprising the receiver to which the omnidirectional signal is applied through a wired or wireless communication link 12. Likewise, the second omnidirectional signal processor is arranged in a housing of the hearing aid comprising the receiver to which the omnidirectional signal is applied and is configured to receive the first monaural directional signal, transmitted by the other hearing aid, through the wired or wireless communication link 12. The second omnidirectional signal processor then generates a second monaural directional signal and mixes the first and second monaural directional signals in a fixed or adjustable ratio to generate a bilateral omnidirectional signal.

Advantageously, the valve control arrangement 30L, 30R can be further configured to open the valve 28L, 28R, which is comprised in the hearing aid 10L, 10R having the receiver to which the omnidirectional signal is applied, more than the valve in the hearing aid having the receiver to which the beamformed signal is applied. By doing so a good low frequency gain in provided and ambient noise travelling to the ear is reduced, which increases the effectiveness of the beamforming and noise reduction and therefore increases speech intelligibility.

The skilled person will understand that each of the signal processing units 22L, 22R may comprise a digital processor e.g. a software programmable microprocessor such as a Digital Signal Processor (DSP). Together, the signal processing units 22L, 22R form the signal processing arrangement 22 of the hearing aid system 1. It is preferred that the signal processing arrangement 22 is provided by signal processing units 22L, 22R in each of the hearing aids 10.

However, alternatively, the signal processing arrangement 22 may be located in a single one of the left or right (first or second) hearing aids 10. In such embodiments, the hearing aid where the processing arrangement 22 is located will leverage the communication connection 12 to transmit processed signals, control signals, etc. from to the other hearing aid, and receive microphone signals from the other hearing aid.

The operation of each of the left and right ear hearing aids 10L, 10R may be controlled by a suitable operating system executed on the software programmable microprocessor. The operating system may be configured to manage hearing aid hardware and software resources, e.g. including computation of the bilateral beamforming signal, computation of the monaural beamforming signals, computation of the hearing loss compensation and possibly other processors and associated signal processing algorithms, the wireless data communication unit 14L, certain memory resources etc. The operating system may schedule tasks for efficient use of the hearing aid resources and may further include accounting software for cost allocation, including power consumption, processor time, memory locations, wireless transmissions, and other resources. The operating system may control the operation of the wireless bidirectional data communication unit 14L such that a first monaural beamforming signal is transmitted to the right ear hearing aid 10R and a second monaural beamforming signal is received from the right ear hearing aid through the wireless bidirectional data communication unit 14L and communication connection 12. The right ear hearing aid 10R may have the same hardware components and software components that function in a corresponding manner.

Figure 2:
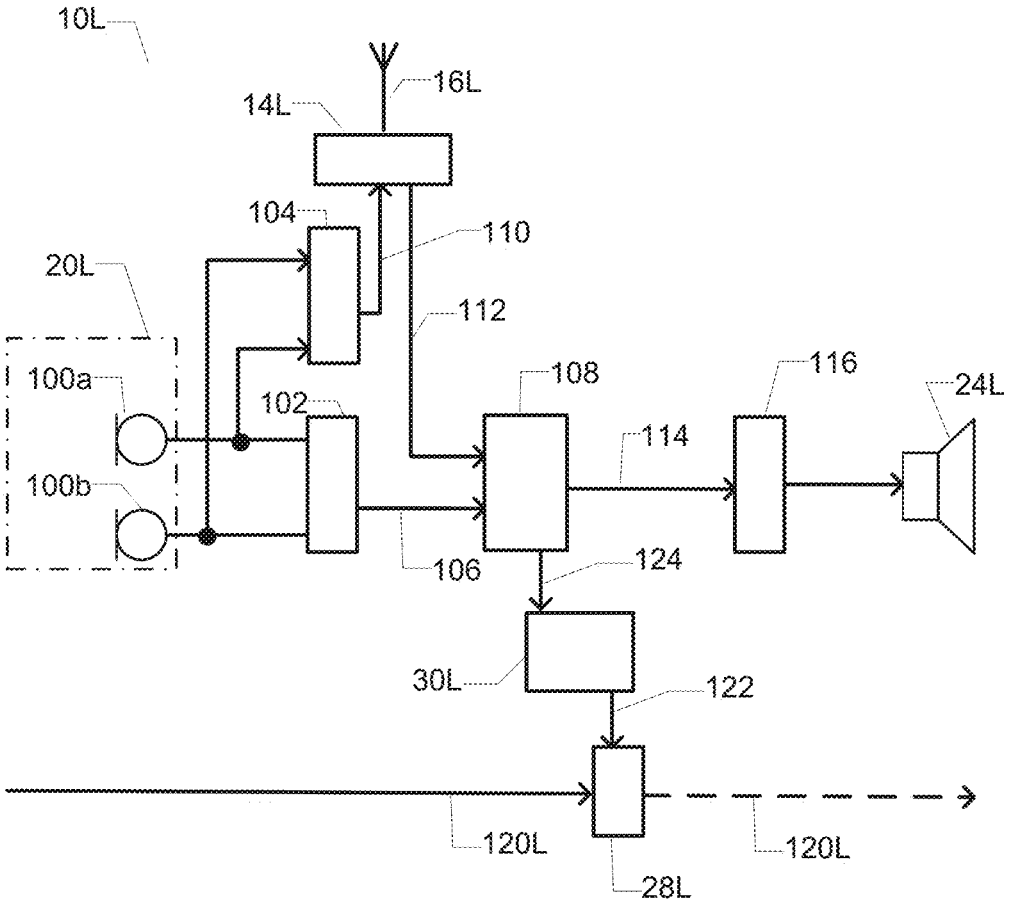
FIG. 2 shows a schematic block diagram of a left hearing aid of the binaural hearing aid system in accordance with an embodiment.

FIG. 2 is a schematic block diagram of an embodiment of a left ear hearing aid 10L for placement at, or in, a user's left ear, of the binaural hearing aid system 1. The illustrated components of the left ear hearing aid 10L may be arranged inside one or several hearing aid housing portion(s) such as BTE, RIE, ITE, ITC, CIC, RIC etc. type of hearing aid housings. The hearing aid 10L comprises a microphone arrangement 20L, which preferably comprises at least the above-mentioned first, and possibly second, omnidirectional microphones 100*a*, 100*b* that generate first and second microphone signals, respectively, in response to incoming or impinging sound. Respective sound inlets or ports (not shown) of the first and second omnidirectional microphones 100*a*, 100*b* are preferably arranged with a certain spacing in one of the housing portions the hearing aid 10L. The spacing between the sound inlets or ports depends on the dimensions and type of the housing portion, but may lie between 5 and 30 mm. This port spacing range enables the formation of the first monaural beamforming signal by applying sum and delay function or algorithm to the first and second microphone signals. The hearing aid 10L preferably comprises one or more analogue-to-digital converters (not shown), which convert the analogue microphone signals into corresponding digital microphone signals with a certain resolution and sampling frequency before application to a first monaural beamformer 102 and, possibly, a second monaural beamformer 104.

The first monaural beamformer 102 is configured to generate a monaural directional signal 106, e.g. a third monaural directional signal, for example by using a sum-and-delay type of beamforming algorithm. The first monaural beamformer 102 is configured to generate the third monaural directional or beamforming signal 106 based on the digitized first and second microphone signals which beamforming signal 106 preferably has a third polar pattern with maximum response or sensitivity in the target direction, i.e. zero degree direction or look direction of the user. The maximum sensitivity at the target direction, or at least very close thereto, for example within an angular range from 350 degrees-10 degrees, makes the third monaural beamforming signal 106 well-suited as input signal to a bilateral beamformer 108, because the third polar pattern exhibits a reduced sensitivity relative to the maximum sensitivity to incoming sound signals arriving from the ipsilateral side of the user's left ear and from the rear hemisphere of the user's head, i.e. at sound incidence directions or angles of about 180 degrees. The relative attenuation or suppression of the sound arriving from the side and rear directions compared to the target direction may be larger than 6 dB, or larger than 10 dB, such as more than 12 dB or 15 dB, determined at 2 kHz using a narrowband test signal such as a sine wave. The response or sensitivity of the third polar pattern may exhibit the same relative attenuation of these off-axis sound signals within a broader frequency range for example as determined by a 1.5 kHz-5 kHz bandlimited white noise signal.

The second monaural beamformer 104 is configured to generate a first monaural directional signal 110 for example using a sum-and-delay type of beamforming algorithm based on the digitized first and second microphone signals supplied by the microphone arrangement 20L. The first monaural directional signal 110 has a first polar pattern with good sensitivity in the target direction and a maximum sensitivity at, or close to, the ipsilateral side of the user's left ear, determined at 2 kHz, using the azimuthal angular convention indicated on FIG. 7. This substantially equal sensitivity in the target direction and at the ipsilateral side of the user's left ear preferably means that the sensitivity of the first polar pattern varies with less than 6 dB, more preferably less than 4 dB such as less than 2 dB, for sound incidence directions or angular range between 180 degrees and 330 degrees determined at 2 kHz using a narrowband test signal such as a sine wave. The response or sensitivity of the first polar pattern may exhibit the same uniformity for the sound incidence directions between 180 degrees and 330 within a broader frequency range for example as determined by a 1.5 kHz-5 kHz bandlimited white noise signal. The first polar pattern may for example be substantially equal to the open ear directional response of KEMAR's left ear.

The signal processing arrangement 22L is configured to transmit the first monaural directional signal 110 to the right ear or side, i.e. contralateral, hearing aid 10R through RF or NFMI antenna 16L and bidirectional data communication unit 14L using a suitable proprietary communication protocol or standardized communication protocol supporting real-time audio. The skilled person will understand that the first monaural directional signal 110 preferably is encoded in a digital format before wireless transmission—for example a standardized digital audio format. The signal processing arrangement 22L is also configured to receive a fourth monaural directional signal 112 from the right ear hearing aid 10R through the bidirectional data communication unit 14L and wireless communication link 12.

The skilled person will understand that the first monaural beamformer 102 may be implemented as dedicated computational hardware integrated on the signal processing arrangement 22L or implemented by a first set of suitable executable program instructions executed on the signal processing arrangement 22L such as the previously discussed programmable microprocessor or DSP or any combination of dedicated computational hardware and executable program instructions. Likewise, the second monaural beamformer 104 may be implemented as dedicated computational hardware of the signal processing arrangement 22L or implemented by a second set of suitable executable program instructions executed on the signal processing arrangement 22L such as the previously discussed programmable microprocessor or DSP or any combination of dedicated computational hardware and executable program instructions.

The third monaural directional signal 106 and the fourth monaural directional signal 112, where the latter is received from the right ear hearing aid 10R, are applied to inputs of a bilateral beamformer 108, which is configured to generate a bilateral beamforming signal 114 in response based on the third and fourth monaural directional signals 106, 112. The bilateral beamforming signal having a polar pattern with maximum sensitivity in the target direction and relatively reduced sensitivity for all other sound incidence angles including at the ipsilateral side of the left ear hearing aid and at the ipsilateral side of the right ear hearing aid and at the back hemisphere of the user's head, e.g. sound incidence angles about 160-200 degrees, determined at 2 kHz using a narrowband test signal such as a sine wave. The response or sensitivity of the bilateral beamforming signal 114 may exhibit the same relative attenuation of these off-axis sound signals within a broader frequency range for example as determined by a 1.5 kHz-5 kHz bandlimited white noise signal. The sensitivity or response of the bilateral beamforming signal 114 for sound incidence at the ipsilateral side of the left ear hearing aid and at the ipsilateral side of the right ear hearing aid may be at least 10 dB such as more than 12 dB or 15 dB smaller than the sensitivity in the target direction determined at 2 kHz using the narrowband test signal.

The skilled person will understand that the bilateral beamformer 108 may be configured to generate the bilateral beamforming signal 114 by applying various types of fixed or adaptive beamforming algorithms known in the art such as a delay and sum beamforming algorithm or a filter and sum beamforming algorithm.

The signal processing arrangement 22L may be configured to apply the bilateral beamforming signal 114 to a conventional hearing loss processor 116 of the left side hearing aid 10L. The conventional hearing loss processor 116 is configured to compensate a hearing loss of the user of the left hearing aid 10L and provides a hearing loss compensated output signal to the miniature loudspeaker or receiver 24L. The conventional hearing loss processor 116 may comprise an output or power amplifier (not shown) such as a class D amplifier, e.g. digitally modulated Pulse Width Modulator (PWM) or Pulse Density Modulator (PDM) etc., to drive a miniature loudspeaker or receiver 24L. The miniature loudspeaker or receiver 24L converts the electrical hearing loss compensated output signal into a corresponding audible signal, e.g. electrical or acoustic output signal, that can be conveyed to the user's ear drum for example via a suitably shaped and dimensioned ear plug of the left hearing aid 10L.

A sound channel connecting the outside of the left hearing aid 10L to the left ear canal of the user allows a left-ear ambient audio signal 120L to travel towards the ear drum of the user. Within the sound channel a valve 28L regulates how much of the ambient audio signal 120L can pass it by being either fully open, partially open or fully closed. In the embodiment of the left hearing aid shown in FIG. 2, the valve 28L in the left hearing aid 10L is fully closed to reduce the amount of ambient sound travelling to the left ear drum of the user and to provide a good low frequency gain, which increases the effectiveness of the beamforming and noise reduction and therefore increases speech intelligibility. In other instances, the valve 28L may be partially or fully open.

The open or closed state of the valve 28L is controlled by a valve control arrangement 30 via a valve control signal 122 from the valve control arrangement 30L to the valve 28L. The valve control arrangement 30L may be configured to respond to a beamformed signal 114 being applied to the receiver 24L of the hearing aid 10L by closing the valve 28L. This may be done e.g. by a signal 124 from the bilateral beamformer 108 to the valve control arrangement 30.

Figure 3:
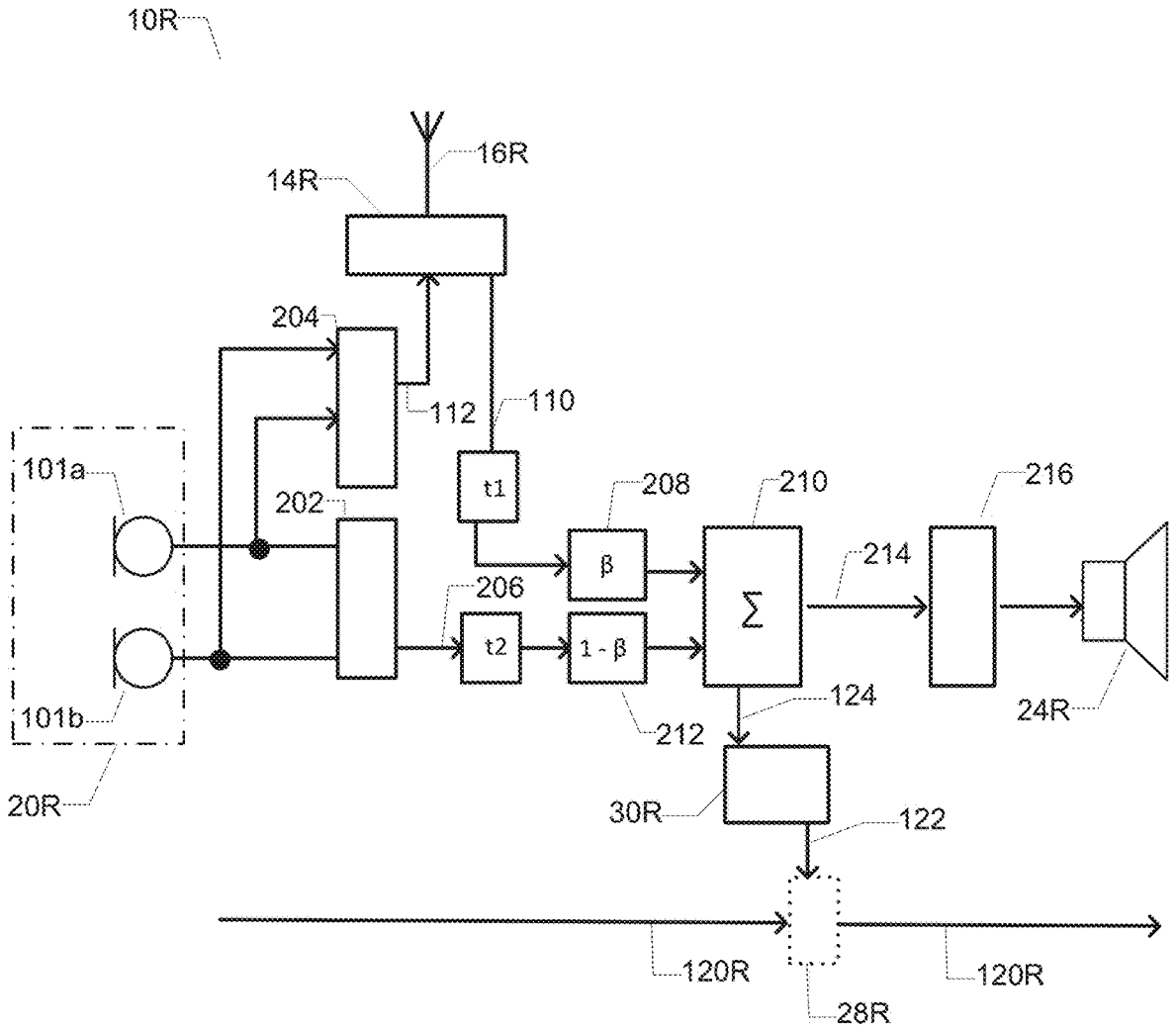
FIG. 3 shows a schematic block diagram of a right hearing aid of the binaural hearing aid system in accordance with an embodiment.

FIG. 3 is a schematic block diagram of an embodiment of a right ear hearing aid or instrument 10R, for placement at, or in, a user's right ear, of the binaural or bilateral hearing aid system 1. The illustrated components of the right ear hearing aid 10R may be arranged inside one or several hearing aid housing portion(s) such as BTE, RIE, ITE, ITC, CIC, RIC etc. type of hearing aid housings, preferably the same type of housing as the previously discussed left ear hearing aid. The hearing aid 10R comprises a second microphone arrangement 20R which may be identical to the above-mentioned first microphone arrangement 20L and therefore comprise first and second omnidirectional microphones 101*a*, 101*b* as illustrated. The hearing aid 10R preferably comprises one or more analogue-to-digital converters (not shown), which convert the analogue microphone signals into corresponding digital microphone signals with a certain resolution and sampling frequency before the corresponding digitized microphone signals are applied to respective inputs of a third monaural beamformer 202 and to respective inputs of a fourth monaural beamformer 204.

The third monaural beamformer 202 is configured to generate the above-discussed fourth monaural directional signal 112. The third monaural beamformer 202 is configured to generate the fourth monaural directional signal 112 for example by using a sum-and-delay type of beamforming algorithm applied to the digitized first and second microphone signals supplied by the second microphone arrangement 20R. The fourth monaural directional signal 112 preferably has a fourth polar pattern with maximum sensitivity in the target direction, i.e. zero degree direction or look direction of the user, i.e. the heading as illustrated on FIG. 7. The maximum sensitivity in the target direction, or at least very close thereto, for example within an angular space from 350 degrees-10 degrees similar to the polar pattern of the third monaural directional signal 106. The fourth polar pattern exhibits a reduced sensitivity relative to the maximum sensitivity to incoming sound arriving from the ipsilateral side of the user's right ear and from the rear hemisphere of the user's head, i.e. at directions of about 180 degrees. The response or sensitivity of the fourth polar pattern may show a relative attenuation or suppression of incoming sound arriving from the ipsilateral side and rear of the user's right ear larger than 6 dB or 10 dB such as larger than 12 dB or even larger than 15 dB determined at 2 kHz using a narrowband test signal such as a sine wave. The response or sensitivity of the fourth polar pattern may exhibit the same relative attenuation of these off-axis sound signals within a broader frequency range for example as determined by a 1.5 kHz-5 kHz bandlimited white noise signal. The fourth monaural directional signal 112 is transmitted to the left ear hearing aid 10L over the wireless communication unit 14R and magnetic coil antenna 16R.

The signal processing arrangement 22 is also configured to implement the functionality of the third monaural beamformer 202, which is configured to generate the second directional microphone signal 206. The second monaural directional signal 206 exhibits a second polar pattern with good sensitivity in the target direction and at the ipsilateral side of the user's right ear, determined at 2 kHz, using the angular convention for sound incidence indicated on FIG. 7. This substantially equal sensitivity in the target direction and at the ipsilateral side of the user's left ear preferably means that the response or sensitivity of the second polar pattern varies with less than 6 dB, more preferably less than 4 dB such as less than 3 dB, in the angular range between 180 degrees and 30 degrees determined at 2 kHz. This substantially equal sensitivity in the target direction and at the ipsilateral side of the user's right ear preferably means that the sensitivity of the second polar pattern varies with less than 6 dB, more preferably less than 4 dB such as less than 2 dB, for sound incidence directions or angular range between 180 degrees and 30 degrees determined at 2 kHz using a narrowband test signal such as a sine wave. The response or sensitivity of the second polar pattern may exhibit the same uniformity for the sound incidence between 180 and 30 degrees within a broader frequency range for example as determined by a 1.5 kHz-5 kHz bandlimited white noise signal. The first polar pattern may for example be substantially equal to the open ear directional response of KEMAR's right ear.

The sensitivity of the second monaural directional signal 206 as reflected in the second polar pattern in the target direction, 360 or 0 degrees, may be about 4-10 dB lower than the sensitivity in the 90 degrees angle for the earlier discussed reasons. The sensitivity of the second monaural directional signal 206 in the target direction, 360 or 0 degrees, may be about 4-10 dB lower than the sensitivity in the 90 degrees direction to allow an appropriate sensitivity of the bilateral omnidirectional signal, aka true-omnidirectional signal, in the target direction after mixing of the second monaural directional signal 206 and a first monaural directional signal 110. The skilled person will appreciate that the polar patterns of the first and second monaural directional signals 110, 206 may be substantially mirror-symmetric about the front-back axis or direction, i.e. from 0 to 180 degrees. The second monaural directional signal 206 possesses a good sensitivity for incoming sound not just from the target direction, but also from a broad angular range about the ipsilateral side of the user's right ear. The skilled person will understand that the second polar pattern preferably is designed such that the sensitivity to sounds arriving at the user's contralateral ear, left ear in the illustrated embodiment, may be significantly smaller than the sensitivity to sounds arriving from the ipsilateral side of the user's left ear, determined at 2 kHz using a narrow-band test signal.

The skilled person will understand that the fourth monaural beamformer 204 may be implemented as dedicated computational hardware integrated on the signal processing arrangement 22 or implemented by a first set of suitable executable program instructions executed on the signal processing arrangement 22 such as the previously discussed programmable microprocessor or DSP or any combination of dedicated computational hardware and executable program instructions. Likewise, the third monaural beamformer 202 may be implemented as dedicated computational hardware of the signal processing arrangement 22 or implemented by a second set of suitable executable program instructions executed on the signal processing arrangement 22 such as the previously discussed programmable microprocessor or DSP or any combination of dedicated computational hardware and executable program instructions.

The skilled person will understand that there exist numerous implementations of the second monaural beamformer 104, which create the first polar pattern of the first monaural directional signal 110 and likewise for the third monaural beamformer 202, which creates the second polar pattern of the second monaural directional signal 206. In certain embodiments of the binaural hearing aid system 1, the second monaural beamformer 104 and the fourth monaural beamformer 204 are entirely omitted which saves computational resources and power consumption of the signal processing arrangement 22. The functionality of the second monaural beamformer 104 and the fourth monaural beamformer 204 are replaced by exploiting natural directional properties of the user's outer ears, e.g. pinnaes and ear canals, for the formation of the first monaural directional signal and the formation of the second monaural directional signal.

The left hearing aid comprises at least one housing portion shaped and sized for placement inside the user's left ear canal. The least one housing portion comprises at least one omnidirectional microphone of the first microphone arrangement 20L with a sound inlet at an outwardly oriented surface of the least one housing portion. Similarly, the right hearing aid comprises least one housing portion shaped and sized for placement inside the user's right ear canal. The at least one housing portion comprises at least one omnidirectional microphone of the right microphone arrangement 20R with a sound inlet at an outwardly oriented surface of the least one housing portion of the right hearing aid. The at least one housing portion of the left hearing aid may be an individually shaped housing of an ITE, CIC or ITC hearing aid or and ear canal plug of an RIC type of hearing aid and the same for the least one housing portion of the right hearing aid.

The signal processing arrangement 22 receives the first monaural directional signal 110 from the left ear hearing aid 10L over the wireless communication unit 14R and magnetic coil antenna 16R. The first monaural directional signal 110 is preferably time delayed relative to the second monaural directional signal 206 before or in connection with being processed by a scaling function 208 and applied to a signal mixer or combiner 210. The relative time delay of the first monaural directional signal 110 is schematically indicated by delay element t1 and includes an inherent transmission time delay of the first monaural directional signal 110 through the wireless communication link 12 and a time delay introduced by the signal processing arrangement 22 to reach a target or desired time delay.

The relatively time-delayed first monaural directional signal 110 is applied to an input of a first scaling function 208, which applies a scaling factor β between 0 and 1 to the first monaural directional signal 110 before a scaled version of the latter is inputted to a signal mixer or combiner 210. The second monaural directional signal 206 is transmitted through an optional time delay function, schematically indicated by delay element t2, before being applied to an input of a second scaling function 212, which applies a scalar scaling factor (1-β) to the second monaural directional signal 206 before the scaled version of the latter signal is applied to a second input of the signal mixer or combiner 210.

The signal mixer or combiner 210 accordingly mixes the first monaural directional signal 110 and the second monaural directional signal 206 in a mixing ratio set by the value of the scalar scaling factor β to generate the bilateral omnidirectional signal 214. The signal processing arrangement 22 may be configured to apply the bilateral omnidirectional signal 214 to the previously discussed conventional hearing loss processor 216 of the right side hearing aid 10R. The conventional hearing loss processor 216 is configured to compensate a hearing loss of the user's right ear and provides a hearing loss compensated output signal to the miniature loudspeaker or receiver 24R. The conventional hearing loss processor 216 and miniature loudspeaker or receiver 24R etc. may be identical to the corresponding components of the above-discussed left ear aid. The target or desired value of the time delay, t1, may be set to a value between 3 ms and 50 ms such as between 5 ms and 20 ms, wherein said time delay is determined at 2 kHz if the time delay varies across the audio frequency range from 100 Hz to 10 kHz.

The introduction of a relative time delay t1 between the first monaural directional signal 110 and the second monaural directional signal 206 leads to several important advantages of the bilateral omnidirectional signal 214 such as providing good perceptual or auditory fusion between the first and second monaural directional signals 110, 206 due to the well-known Haas effect, which is particularly pronounced for relative time delay t1 between 5 and 20 ms. Another advantage of the relative time delay t1 is its decorrelation of the first and second monaural directional signals 110, 206 thereby minimizing signal cancellation effects, when the first and second monaural directional signals 110, 206 are summed or added by the signal mixer or combiner 210.

A sound channel connecting the outside of the right hearing aid 10R to the right ear canal of the user allows a right-ear ambient audio signal 120R to travel towards the ear drum of the user. Within the sound channel a valve 28R regulates how much of the ambient audio signal 120R can pass it by being either fully open, partially open or fully closed. In the embodiment of the right hearing aid shown in FIG. 3, the valve 28R in the right hearing aid 10R is partially or fully open to reduce occlusion and the discomfort associated with it.

The open or closed state of the valve 28R is controlled by a valve control arrangement 30R via a valve control signal 122 from the valve control arrangement 30R to the valve 28R. The valve control arrangement 30R may be configured to respond to an omnidirectional signal 214 being applied to the receiver 24R of the hearing aid 10R by closing the valve 28R. This may be done e.g. by a signal 124 from the signal mixer 210 to the valve control arrangement 30R.

In the embodiments shown in FIGS. 2 and 3, each hearing aid 10R, 10L comprises a valve control arrangement 30R, 30L, however, it may also be that only one of the hearing aids 10R, 10L comprises a valve control arrangement 30 as described above for FIG. 1.

Figure 4:
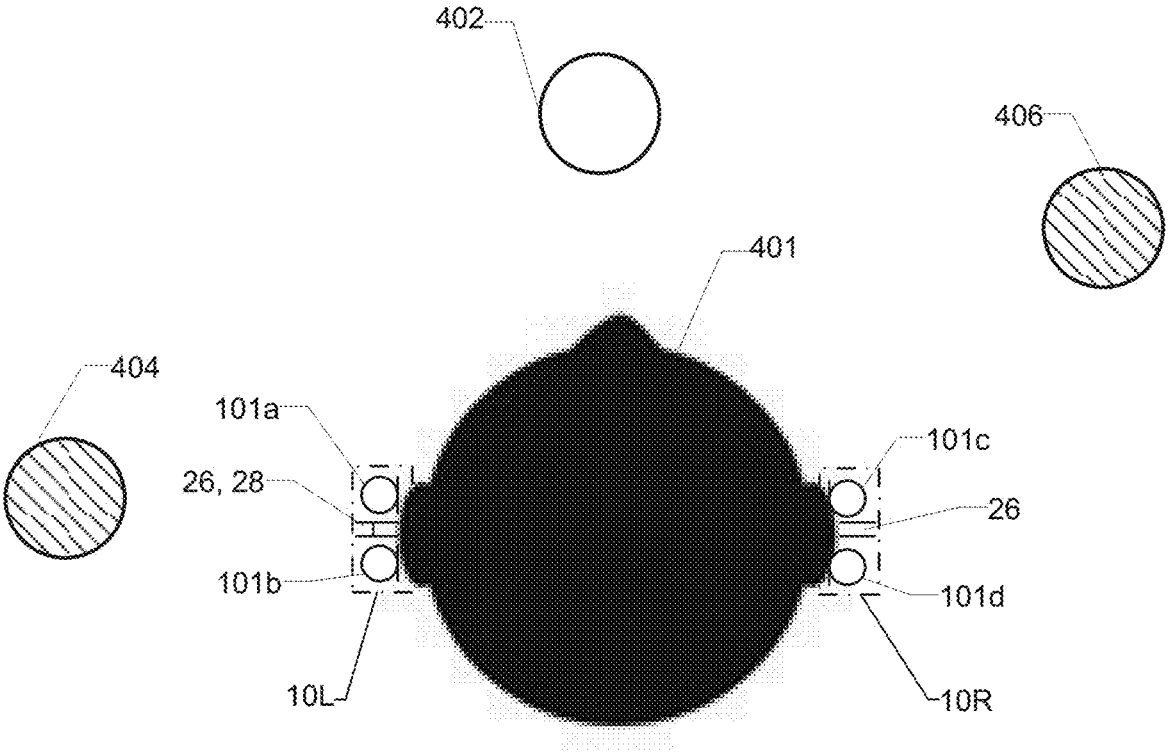
FIG. 4 is a schematic illustration of a hearing impaired individual fitted with a binaural hearing aid system in accordance with exemplary embodiments.

FIG. 4 is a schematic illustration of a hearing impaired individual 401 fitted with a binaural hearing aid system comprising first and second hearing aids 10L, 10R mounted at the user's left and right ears. The illustrative sound source arrangement or setup comprises a target sound source 402, e.g. a desired speaker, placed in a target direction at 0 degrees azimuth. The sound source arrangement may include one or more interfering sound sources 404, 406 arranged around the user's head at various off-axis directions, i.e. outside the target direction.

Figure 5:
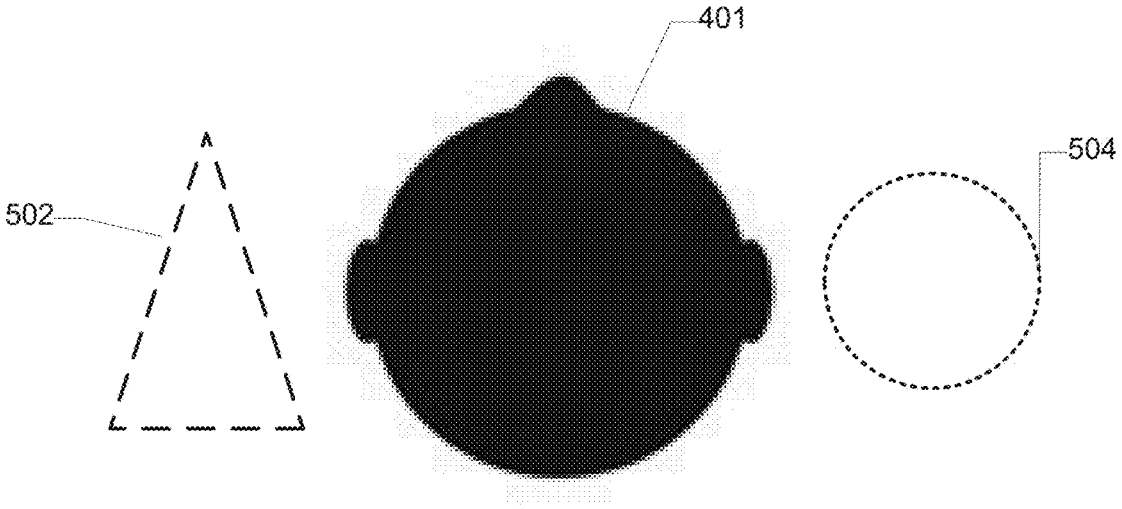
FIG. 5 is a schematic illustration of the properties of the bilateral beamforming signal and the bilateral omnidirectional signal generated by exemplary embodiments of the binaural hearing aid system.

FIG. 5 is a schematic illustration of the high directivity index of the bilateral beamforming signal 502 applied to the user's left ear and the relatively much lower directivity index of the bilateral omnidirectional signal 504 applied to the user's right ear by exemplary embodiments of the bilateral hearing aid system.

Figure 6:
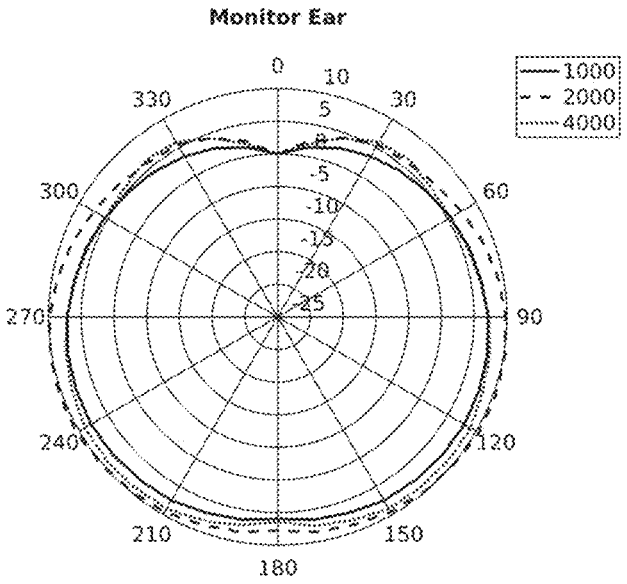
FIG. 6 shows a set of measured polar patterns of the bilateral omnidirectional microphone signal based on the first and second monaural directional signals at test frequencies 1, 2 and 4 kHz with the second hearing aid fitted on KEMAR's right ear.

FIG. 6 shows a set of measured polar patterns of the bilateral omnidirectional signal 214 based on a mixing of the first and second monaural directional signals 110, 206 at test frequencies 1, 2 and 4 kHz with the binaural hearing aid system fitted on KEMAR's left and right ears. The bilateral omnidirectional signal 214 is generated using a fixed scalar scaling factor $\beta$ of 0.5.

Figure 7:
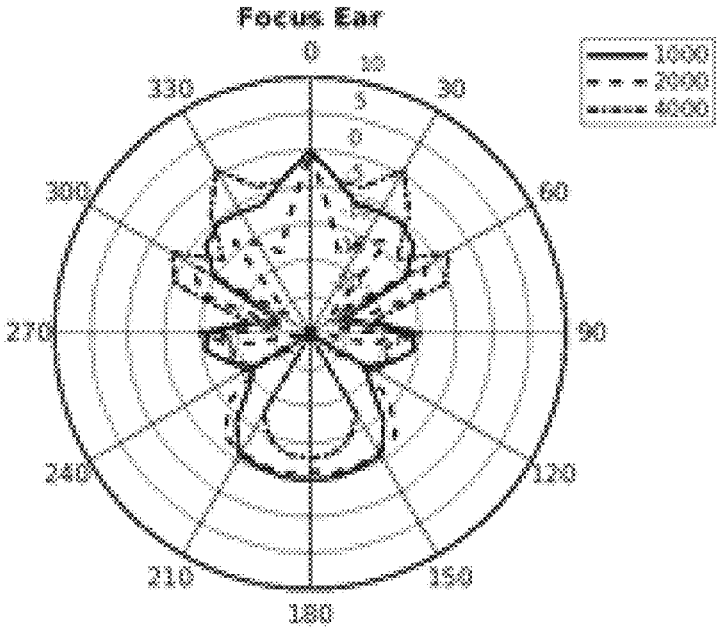
FIG. 7 shows a set of polar patterns, measured at 1 kHz, 2 kHz and 4 kHz, of the bilateral beamforming signal generated by an exemplary embodiment of the bilateral beamformer of a hearing aid in the bilateral hearing aid system.

FIG. 7 shows respective polar patterns of the bilateral beamforming signal 114 determined at 1 kHz, 2 kHz and 4 kHz for the above-disclosed embodiment of the bilateral beamformer 108. The polar patterns of the bilateral beamforming signal 114 are obtained by measuring its sensitivity as a function of the azimuthal angles 0-360 degrees of the test sound source. The left side and right side hearing aids are appropriately placed on KEMAR or a similar acoustic manikin which simulates average acoustic properties of the human head and torso. The test sound source may generate a broad-band test signal such as a Maximum-Length Sequence (MLS) sound signal which is reproduced at each azimuthal angle from 0 to 360 degree in steps of a predetermined size, e.g. 5 or 10 degrees. The acoustic transfer function is derived from the bilateral beamformed signal 114 and the test signal. The power spectrum of the acoustic transfer function represents a magnitude response of the bilateral beamforming signal 114 at each azimuthal angle. For adaptive beamformers and beamforming algorithms, in order to avoid over-estimating sensitivity of the beamforming signal 114, it may be advantageous to apply a Schroeder phase complex harmonic as the acoustic test sound signal in a diffuse sound field to simulate a realistic acoustic environment of the user. The magnitude spectral response may for example be estimated based on harmonics amplitude between the test sound signal playback and the bilateral beamforming signal 114 obtained in response.

Items

1. A binaural hearing aid system comprising:

a first hearing aid for placement at, or in, a user's left or right ear, said first hearing aid comprising a first microphone arrangement, a first wireless communications unit, a first receiver, and a first sound channel comprising a first valve which is movable from an open state to a closed state and from a closed state to an open state;

a second hearing aid for placement at, or in, the user's opposite ear, said second hearing aid comprising a second microphone arrangement, a second wireless communications unit, and a second sound channel comprising a second valve which is movable from an open state to a closed state and from a closed state to an open state;

a signal processing arrangement adapted for generating a beamformed signal based on microphone signals supplied by the first and/or second microphone arrangement(s) and for applying the beamformed signal to the first and/or second receiver(s); and a valve control arrangement which has an asymmetric mode, in which asymmetric mode the valve control arrangement is configured to asymmetrically control the first and second valves by moving the first and second valves into positions wherein one of the first or second valves is opened more than the other of the first or second valves.

2. The binaural hearing aid system according to item 1, wherein the signal processing arrangement is adapted for generating an omnidirectional signal based on microphone signals supplied by the first and/or second microphone arrangement(s), and wherein the signal processing arrangement is adapted for applying the beamformed signal to one of the first or the second receiver and applying the omnidirectional signal to the other one of the first or the second receiver.

3. The binaural hearing aid system according to item 2, wherein the valve control arrangement is further configured to open the valve, which is comprised in the hearing aid comprising the receiver to which the omnidirectional signal is applied, more than the valve, which is comprised in the hearing aid comprising the receiver to which the beamformed signal is applied, when in the asymmetric mode.

4. The binaural hearing aid system according to any of items 2 or 3, wherein the omnidirectional signal is a bilateral omnidirectional signal based on microphone signals supplied by the first and second microphone arrangements.

5. The binaural hearing aid system according to item 4, wherein the microphone signal supplied by the hearing aid comprising the receiver to which the beamformed signal is applied is time delayed relative to the microphone signal supplied by the hearing aid comprising the receiver to which the omnidirectional signal is applied before the two microphone signals are mixed to generate the bilateral omnidirectional signal.

6. The binaural hearing aid system according to any of the previous items, wherein the beamformed signal is based at least on two or more microphone signals supplied in response to incoming sound by the microphone arrangement comprised in the hearing aid comprising the receiver to which the beamformed signal is applied.

7. The binaural hearing aid system according to any of items 2-6, wherein the hearing aid system further comprises an omnidirectional processing arrangement, which comprises a first omnidirectional signal processor and a second omnidirectional signal processor;

the first omnidirectional signal processor being arranged in a housing of the hearing aid comprising the receiver to which the beamformed signal is applied and being configured to:

generating a first monaural directional signal, transmitting, through a wired or wireless communication link, the first monaural directional signal to the hearing aid comprising the receiver to which the omnidirectional signal is applied; and the second omnidirectional signal processor being arranged in a housing of the hearing aid comprising the receiver to which the omnidirectional signal is applied and being configured to:

receiving the first monaural directional signal, transmitted by the other hearing aid, through the wired or wireless communication link, generating a second monaural directional signal and mixing the first and second monaural directional signals in a fixed or adjustable ratio to generate a bilateral omnidirectional signal.

8. The binaural hearing aid system according to item 7, wherein the signal processing arrangement and the omnidirectional processing arrangement are comprised in the same processing unit.

9. The binaural hearing aid system according to any of items 1-8, wherein the signal processing arrangement comprises a first signal processing unit housed in the first hearing aid and a second signal processing unit housed in the second hearing aid.

10. The binaural hearing aid system according to any of the preceding items, wherein the valve control arrangement is additionally configured to fully close the first valve, when the second valve is opened and to fully close the second valve, when the first valve is opened.

11. The binaural hearing aid system according to any of the preceding items, wherein the valve of the first or the second hearing aid is opened by the valve control arrangement in response to an omnidirectional signal being applied to the receiver of the first or second hearing aid, respectively; and/or wherein the valve of the first or second hearing aid is closed by the valve control arrangement in response to a beamformed signal being applied to the receiver of the first or second hearing aid, respectively.

12. The binaural hearing aid system according to any of the preceding items, wherein the first valve is further configured to open at least partially or close at least partially in response to a first valve control signal and the second valve is further configured to open at least partially or close at least partially in response to a second valve control signal.

13. The binaural hearing aid system according to any of the preceding items, wherein the first sound channel is located in a part of the first hearing aid which resides in an ear canal of the user during use and the second sound channel is located in a part of the second hearing aid which resides in the opposite ear canal of the user during use.

14. The binaural hearing aid system according to any of the preceding items, wherein the valve control arrangement is adapted to engage the asymmetric mode in response to the hearing aid system entering a conversation mode, the conversation mode being entered upon request by the user or in response to a signal strength of microphone signal from the first and or second microphone arrangements crossing a noise threshold.

15. A method of providing a beamformed signal at a left or right ear of a hearing aid user and a bilateral omnidirectional signal at the opposite ear of the hearing aid user; the method comprising:

by a beamforming arrangement generating a bilaterally or monaurally beamformed signal based at least on two or more microphone signals supplied by a microphone arrangement of a hearing aid in the user's left or right ear;

converting the bilaterally or monaurally beamformed signal into a corresponding audible beamformed signal for the user's corresponding left or right ear;

by an omnidirectional processing arrangement generating a first monaural directional signal based on one or more microphone signals supplied by the microphone arrangement of a hearing aid in the user's left or right ear;

by an omnidirectional processing arrangement generating a second monaural directional signal based on one or more microphone signals supplied by the microphone arrangement of the opposite hearing aid;

mixing the first and second monaural directional signals in a fixed or adjustable ratio to generate the bilateral omnidirectional signal;

converting the bilateral omnidirectional signal into a corresponding audible omnidirectional signal for the user's opposite ear, and by a valve control arrangement carrying out steps of closing a valve in the hearing aid in the user's left or right ear; and opening a valve in the hearing aid in the user's opposite ear.

LIST OF REFERENCES

1 Binaural hearing aid system
10 Left/Right hearing aid
12 Data communication connection or link
14 Wireless communication unit
16 Antennas
18 Hearing aid circuit
20 Microphone arrangement
22 Signal processing arrangement
22L Signal processing unit
22R Signal processing unit
24 Receiver
26 Sound channel
28 Valve
30 Valve control arrangement
100 Omnidirectional microphones
102 First monaural beamformer
104 Second monaural beamformer
106 Third monaural directional signal
108 Bilateral beamformer
110 First monaural directional signal
112 Fourth monaural directional signal
114 Bilateral beamforming signal
116 Conventional hearing loss processor
120 Ambient audio signal
122 Valve control signal

124 Signal from bilateral beamformer to valve control arrangement
202 Third monaural beamformer
204 Fourth monaural beamformer
206 Second monaural directional signal
208 First scaling function
210 Signal mixer or combiner
212 Second scaling function
214 Bilateral omnidirectional signal
216 Conventional hearing loss processor
401 Hearing-impaired individual
402 Target sound source
404 Interfering sound source
406 Interfering sound source
502 Directivity of bilateral beamforming signal
504 Directivity of bilateral omnidirectional signal
t1,t2 delay element

The invention claimed is:

1. A binaural hearing aid system comprising:

a first hearing aid for placement at, or in, a first ear of a user, the first hearing aid comprising a first microphone arrangement, a first wireless communication unit, a first receiver, and a first sound channel comprising a first valve;

a second hearing aid for placement at, or in, a second ear of the user, the second hearing aid comprising a second microphone arrangement, a second wireless communication unit, and a second sound channel comprising a second valve;

a signal processing arrangement configured to generate a beamformed signal and an omnidirectional signal, wherein the signal processing arrangement is configured to apply the beamformed signal to one of the first receiver in the first hearing aid or the second receiver in the second hearing aid, and to apply the omnidirectional signal to the other one of the first receiver in the first hearing aid or the second receiver in the second hearing aid; and a valve control arrangement configured to asymmetrically control the first and second valves by moving the first valve and/or the second valve so that one of the first valve or the second valve, which is in one of the first hearing aid or the second hearing aid in which the omnidirectional signal is applied, is opened more than the other one of the first valve or the second valve, which is in the other one of the first hearing aid or the second hearing aid in which the beamformed signal is applied.

2. The binaural hearing aid system according to claim 1, wherein the omnidirectional signal is a bilateral omnidirectional signal.

3. The binaural hearing aid system according to claim 2, wherein one of the first hearing aid or the second hearing aid in which the beamformed signal is applied is configured to provision a first microphone signal;

wherein the other one of the first hearing aid or the second hearing aid in which the omnidirectional signal is applied is configured to provision a second microphone signal;

wherein the binaural hearing aid system is configured to time delay the first microphone signal relative to the second microphone signal; and wherein the bilateral omnidirectional signal is based on a mixing of the time-delayed first microphone signal and the second microphone signal.

4. The binaural hearing aid system according to claim 1, wherein the beamformed signal is based at least on two or more microphone signals supplied by one of the first microphone arrangement or the second microphone arrangement comprised in one of the first hearing aid or the second hearing aid in which the beamformed signal is applied.

5. The binaural hearing aid system according to claim 1, further comprising an omnidirectional processing arrangement, which comprises a first omnidirectional signal processor and a second omnidirectional signal processor;

wherein the first omnidirectional signal processor is a part of the first hearing aid or the second hearing aid in which the beamformed signal is applied; and wherein the second omnidirectional signal processor is a part of the first hearing aid or the second hearing aid in which the omnidirectional signal is applied.

6. The binaural hearing aid system according to claim 5, wherein the first omnidirectional signal processor is configured to:

generate a first monaural directional signal;

transmit, through a wired or wireless communication link, the first monaural directional signal to one of the first hearing aid or the second hearing aid in which the omnidirectional signal is applied.

7. The binaural hearing aid system according to claim 6, wherein the second omnidirectional signal processor is configured to:

receive the first monaural directional signal;

generate a second monaural directional signal; and mix the first and second monaural directional signals in a fixed or adjustable ratio to generate a bilateral omnidirectional signal.

8. The binaural hearing aid system according to claim 5, wherein the signal processing arrangement and the omnidirectional processing arrangement are comprised in a same processing unit.

9. The binaural hearing aid system according to claim 1, wherein the signal processing arrangement comprises a first signal processing unit housed in the first hearing aid and a second signal processing unit housed in the second hearing aid.

10. The binaural hearing aid system according to claim 1, wherein the valve control arrangement is configured to fully close the first valve when the second valve is opened, and to fully close the second valve when the first valve is opened.

11. The binaural hearing aid system according to claim 1, wherein the valve control arrangement is configured to open one of the first valve or the second valve in response to an omnidirectional signal being applied in a corresponding one of the first hearing aid or the second hearing aid.

12. The binaural hearing aid system according to claim 1, wherein the valve control arrangement is configured to close one of the first valve or the second valve in response to a beamformed signal being applied in a corresponding one of the first hearing aid or the second hearing aid.

13. The binaural hearing aid system according to claim 1, wherein the first valve is configured to open at least partially or close at least partially in response to a first valve control signal, and wherein the second valve is configured to open at least partially or close at least partially in response to a second valve control signal.

14. The binaural hearing aid system according to claim 1, wherein the first sound channel is located in a part of the first hearing aid which is configured for placement in a first ear canal of the user, and wherein the second sound channel is located in a part of the second hearing aid which is configured for placement in a second ear canal of the user.

15. The binaural hearing aid system according to claim 1, wherein the valve control arrangement is configured to asymmetrically control the first and second valves in response to the binaural hearing aid system entering a conversation mode.

16. The binaural hearing aid system according to claim 15, wherein the binaural hearing aid system is configured to enter the conversation mode upon request by the user.

17. The binaural hearing aid system according to claim 15, wherein the binaural hearing aid system is configured to enter the conversation mode in response to a signal strength (s) of microphone signal(s) from the first microphone arrangement and/or the second microphone arrangement crossing a noise threshold.

18. The binaural hearing aid system according to claim 1, wherein the signal processing arrangement is configured to generate the beamformed signal based on microphone signals supplied by the first microphone arrangement and/or the second microphone arrangement.

19. The binaural hearing aid system according to claim 1, wherein the signal processing arrangement is configured to generate the omnidirectional signal based on microphone signals supplied by the first microphone arrangement and/or the second microphone arrangement.

20. A method of providing a beamformed signal for a first ear of a hearing aid user and a bilateral omnidirectional signal for a second ear of the hearing aid user, the method comprising:

generating, by a beamforming arrangement, a bilaterally or monaurally beamformed signal based at least on two or more microphone signals supplied by a first microphone arrangement of a first hearing aid in the first ear of the hearing aid user;

converting the bilaterally or monaurally beamformed signal into a corresponding audible beamformed signal for the first ear of the hearing aid user;

generating a first monaural directional signal based on one or more microphone signals provided by the first microphone arrangement of the first hearing aid in the first ear of the hearing aid user;

generating a second monaural directional signal based on one or more microphone signals provided by a second microphone arrangement of a second hearing aid in the second ear of the hearing aid user;

mixing the first and second monaural directional signals in a fixed or adjustable ratio to generate the bilateral omnidirectional signal;

converting the bilateral omnidirectional signal into a corresponding audible omnidirectional signal for the second ear of the hearing aid user;

closing, by a valve control arrangement, a first valve in the first hearing aid in the first ear of the hearing aid user; and opening a second valve in the second hearing aid in the second ear of the hearing aid user.

* * * * *